United States Patent [19]

Sakamoto et al.

[11] Patent Number: 4,575,220

[45] Date of Patent: Mar. 11, 1986

[54] DEVELOPING DEVICE

[75] Inventors: Koji Sakamoto; Toshio Kaneko, both of Tokyo; Fuchio Kanno; Wataru Yasuda, both of Yokohama, all of Japan

[73] Assignee: Ricoh Company, Ltd., Tokyo, Japan

[21] Appl. No.: 561,534

[22] Filed: Dec. 14, 1983

[30] Foreign Application Priority Data

Dec. 14, 1982 [JP] Japan ..... 57-187955[U]

[51] Int. Cl.[4] ..... G03G 15/09

[52] U.S. Cl. ..... 355/3 DD; 118/658

[58] Field of Search ..... 355/3 DD, 14 D; 118/647, 657, 658, 653

[56] References Cited

U.S. PATENT DOCUMENTS 3,822,139 7/1974 Westdale ..... 118/658 X
4,425,382 1/1984 Tajima ..... 355/3 DD X
4,445,771 5/1984 Sakamoto et al. ..... 118/647 X

FOREIGN PATENT DOCUMENTS 0088083 7/1980 Japan ..... 355/3 DD

*Primary Examiner*—A. T. Grimley
*Assistant Examiner*—J. Pendegrass
*Attorney, Agent, or Firm*—Guy W. Shoup

[57] ABSTRACT

A device for developing an electrostatic latent image formed on a photosensitive member includes a developing sleeve which is driven to rotate in a predetermined direction and a pressure blade which is kept pressed against the sleeve to form a thin film of uniformly charged toner so as to apply for the latent image for development. In accordance with the present invention, the forward end portion of the pressure blade is specifically shaped such that a projection having the width which substantially corresponds to the width of an image forming area of the photosensitive member is provided to extend beyond a contact line between the sleeve and the blade thereby allowing to form the thin film of toner whose width substantially corresponds to the image forming area of the photosensitive member, thereby preventing the waste of toner from occurring.

7 Claims, 5 Drawing Figures

DEVELOPING DEVICE

BACKGROUND OF THE INVENTION

1. Field of the Invention

This invention generally relates to a developing device for developing an electrostatic latent image formed on an imaging surface such as a photo-sensitive member for use in electrophotography, and particularly to a developing device for developing such a latent image by applying a thin film of charged toner particles thereto.

2. Description of the Prior Art

In general, in developing an electrostatic latent image using a single component developer, normally comprised of magnetic toner particles, in the field of electrophotography, it is required to form a thin film of uniformly charged magnetic toner particles prior to the application to the latent image. In one approach, use is made of a pressure member comprised of an elastic and magnetic blade, which is pressed against a developing sleeve, which is driven to rotate in a predetermined direction, across its full width, thereby forming a thin film of charged toner particles on the peripheral surface of the sleeve. In this case, it is desired that no such thin film of toner particles is formed in those portions to the non-image forming regions of the imaging surface on which the latent image is formed so as to reduce the waste of toner and to prevent contamination by floating toner within the machine. For this reason, the prior art approach was to provide seal members at those portions of the pressure member corresponding in position to the non-image forming regions thereby selectively preventing the thin film of toner particles from being formed on the developing sleeve. However, since such seal members are held between the pressure member and the developing sleeve under pressure, the thin film forming performance is directly affected by the conditions of these seal members, thereby making it difficult to form a desired thin film of toner particles stably at all times.

SUMMARY OF THE INVENTION

Therefore, it is a primary object of the present invention to provide a developing device which is free of the above-described disadvantages of the prior art.

Another object of the present invention is to provide a developing device which is capable of forming a desired thin film of uniformly charged toner particles stably at all times.

A further object of the present invention is to provide a developing device which is extremely efficient in the usage of toner particles.

A still further object of the present invention is to provide a developing device which is simple in structure and particularly suited for use in developing an electrostatic latent image formed on an imaging surface such as a photosensitive member.

Other objects, advantages and novel features of the present invention will become apparent from the following detailed description of the invention when considered in conjunction with the accompanying drawings.

BRIEF DESCRIPTION OF THE DRAWINGS

FIGS. 2*a* and 2*b* are fragmentary views, each showing part of the structure shown in FIG. 1, wherein FIG. 2*a* shows the contact region between the pressure blade and the developing sleeve and FIG. 2*b* shows the forward end portion of the pressure blade in plan view;

DESCRIPTION OF THE PREFERRED EMBODIMENTS

Figure 1:
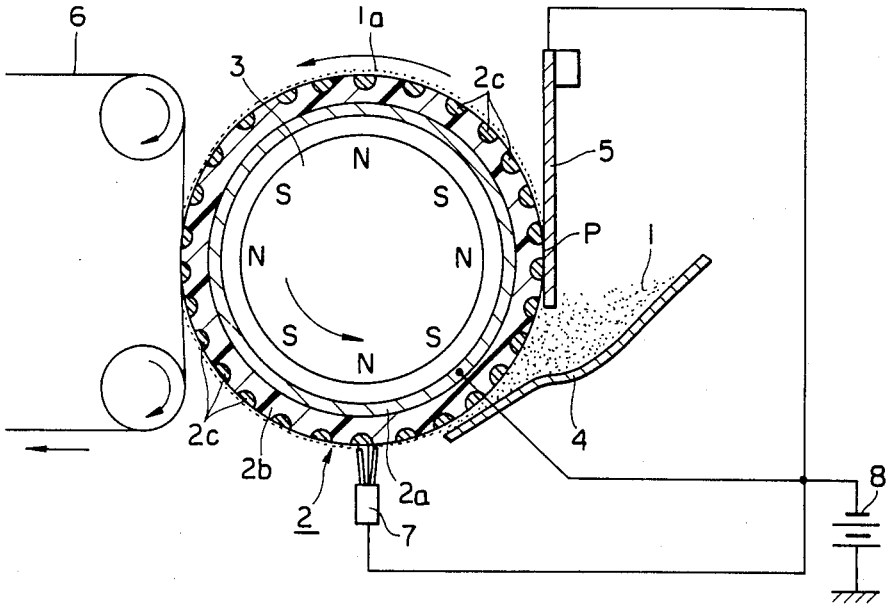
FIG. 1 is a schematic illustration showing the developing device for developing an electrostatic latent image by applying a thin film of charged toner particles constructed in accordance with one embodiment of the present invention.

Referring now to the drawings, the present invention will be described in detail by way of embodiments. FIG. 1 schematically illustrates the developing device embodying the present invention when applied to an electrophotographic copying machine. As shown, the present developing device includes a rotatably supported developing sleeve 2, which is also often referred to as toner carrier, and it is driven to rotate in the direction indicated by the arrow at a constant speed thereby having toner 1 transported as riding thereon along a predetermined path defined by the peripheral surface of the sleeve 2. The developing sleeve 2 includes a cylindrical base 2*a* of electrical conductive material and a dielectric layer 2*b* of a dielectric material, such as epoxy resin and polyester resin, formed on the outer peripheral surface of the base 2*a* to the thickness of approximately 600 microns with a number of fine electrodes 2*c* provided as scattered across the outer peripheral surface of the dielectric layer 2*b* circumferentially as well as axially. These electrodes 2*c* are made of an electrically conductive material such as metal, preferably copper, and, for example, copper particles of approximately 80 microns in diameter are provided as embedded in the outer surface portion of the dielectric layer 2*b* and then the outer peripheral surface of the dielectric layer 2*b* is ground to have the copper particles exposed partially at the ground smooth surface, thereby providing a plurality of floating electrodes spaced apart from each other as anchored in the dielectric layer 2*b*. Inside the developing sleeve 2 is disposed a columnar magnet 3 having the surface magnetic flux density of 600 Gauss and rotatably supported to be coaxial with the developing sleeve 2, and the magnet 3 is driven to rotate at constant speed in the same direction as that of the sleeve 2. In the illustrated embodiment, the electrically conductive base 2*a* is connected to a bias voltage source 8 of negative polarity. Preferably, the developing sleeve 2 is driven to rotate at the peripheral speed of approximately 500 mm/sec. and the magnet 3 at approximately 1,500 r.p.m.

At an appropriate positon in the vicinity of the peripheral surface of the developing sleeve 2 is disposed a hopper 4 for supplying the magnetic toner 1 to the developing sleeve 2. The magnetic tonter 1 includes magnetic powder 45% by weight as mixed in a resin and it has been prepared to have the average diameter of approximately 9 microns and the true specific weight of 1.85.

Figure 2A:
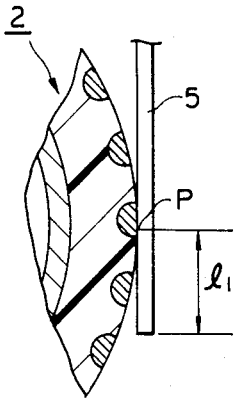
Figure 2B:
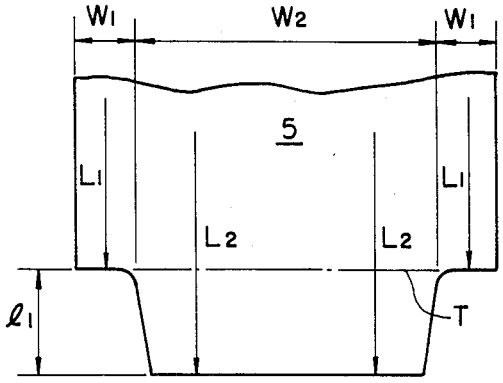

Downstream of the hopper 4 with respect to the rotational direction of the developing sleeve 2 is disposed a pressure blade 5 comprised of a magnetic material, such as a SK material of approximately 0.1 micron thick, having sufficient resiliency. The blade 5 is thus magnetically attracted by the magnet 3 disposed inside of the developing sleeve 2 to be pressed against the peripheral surface of the sleeve 2. As shown in FIGS. 2*a* and 2*b*, the blade 5 has its forward end portion, or bottom portion in the illustrated example, specially shaped such that the forward end of each of the side regions having the width $W_1$ is terminated short of the forward end of the central region having the width $W_2$. That is, when measured from the top or base end of the pressure plate 5, which is pivotally supported to a stationary object such as the machine housing, the side region has the length $L_1$ which is shorter than the length $L_2$ of the central region. Preferably, the width $W_2$ of the central region is set to correspond to the width of the image forming region of an imaging surface such as a photosensitive member to which the developing sleeve 2 is brought into contact.

Figure 3:
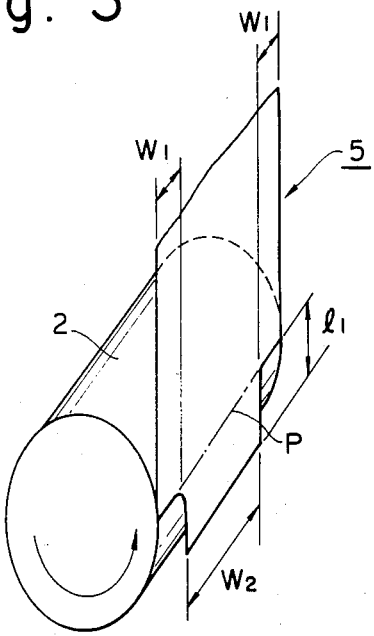
FIG. 3 is a schematic, perspective view of the developing device shown in FIG. 1, showing how the pressure blade is in contact with the peripheral surface of the developing sleeve.

In the illustrated embodiment, the pressure blade 5 having the above-described shape is arranged to be in pressure contact with the developing sleeve 2 such that an imaginary dotted line T defined by connecting the two forward ends of the side regions is located in the neighborhood of, or preferably at or slightly above, the contact line between the pressure blade 5 and the developing sleeve 2. As a result, even if the pressure blade 5 is set to be in pressure contact with the sleeve 2 across its full width at a contact line P, the length l of projection from the contact line P in the forward direction, or downward direction in the illustrated example, differs between the central and side regions. In the embodiment shown in FIG. 3, the pressure blade 5 is so provided with its imaginary connection line T substantially aligned with the contact line P between the sleeve 2 and the blade 5 so that the central region extends downward approximately by the length of $l_1$, but the side regions are terminated substantially at the contact line P.

Figure 4:
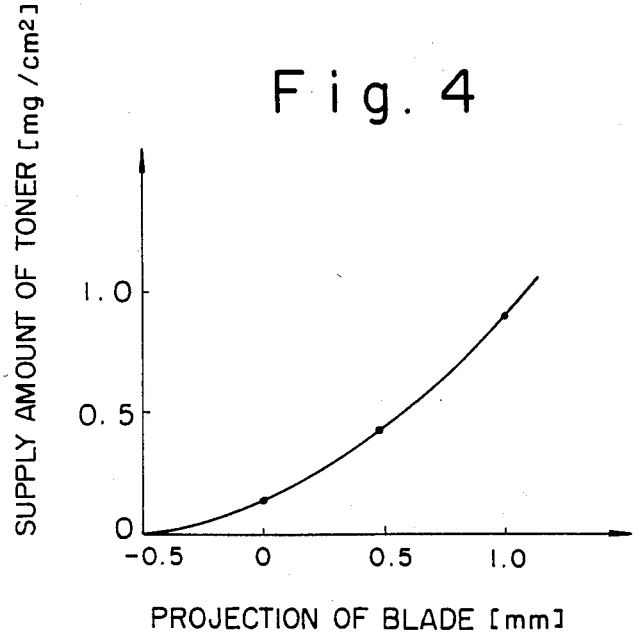
FIG. 4 is a graph showing the relation between the amount of projection of the pressure blade and the amount of toner transported, which is useful for understanding the importance of the present invention.

It will now be described as to the reason for forming the pressure blade 5 into such a shape. The present inventors have experimentally determined that the supply amount of toner is related to the amount of projection of blade beyond the contact line with the developing sleeve as graphically shown in FIG. 4. From this, it is seen that the smaller the amount of projection, the smaller the supply amount of toner, and eventually zero supply point may be reached when the forward end is located slightly above the contact line. Based on this finding, selected portions of the pressure blade 5 at its forward end are removed so as not to form a thin toner film in the regions corresponding to those portions. In the illustrated embodiment, the side portions each across the width $W_1$ from the side edge are removed corresponding in position to the non-image forming region, e.g., side marginal area.

With the pressure plate 5 having the structure as described above, a thin toner film will be prevented from being formed on the peripheral surface of the developing sleeve 2 in those areas corresponding in position to the side regions of pressure blade 5 over the width $W_1$ on both sides, thereby allowing to use toner efficiently without causing over-supply of toner, which could produce the toner floating in the air resulting in contamination of the interior of the machine. More importantly, since provision of extra elements such as seal members is not required, it is easy to manufacture and there is no chance that the toner film forming performance is adversely affected. It is noted in passing that the pressure blade 5 is also connected to the negative bias voltage source 8 in the illustrated embodiment.

Returning to FIG. 1, at a location further downstream with respect to the rotational direction of the developing sleeve 2 and at the side opposite to the side where the pressure blade 5 is disposed with respect to the developing sleeve 2 is provided a photosensitive belt 6 of the endless type driven to advance in the direction indicated by the arrow. In the illustrated embodiment, the belt 6 is in rolling pressure contact with the developing sleeve 2, and, thus, the toner 1 is supplied to the surface of photosensitive belt 6 in the form of thin film 1*a* as carried on the peripheral surface of sleeve 2. The belt 6 includes a base layer of electrically conductive material in the form of an endless belt and a photosensitive layer of photoconductive material formed on the base layer. As the belt 6 advances, its outer surface is uniformly charged to a predetermined polarity and then exposed to a light image to form an electrostatic latent image thereon as well known in the field of electrophotography. The belt 6 bearing thereon the latent image thus formed then comes to a developing region where the thin film 1*a* of toner formed on the developing sleeve 2 is supplied and thus the latent image is developed thereby providing a visualized toner image.

In the structure shown in FIG. 1, further downstream of the developing region is disposed an electrically conductive brush 7 for removing the remaining charge from the surface of the sleeve 2. The brush 7 is so disposed to have its tip end in the vicinity or lightly in contact with the peripheral surface of the sleeve 2. Besides, the brush 7 is also connected to the negative bias voltage source 8 similarly with the base 2*a* and the pressure blade 5.

In operation, as the developing sleeve 2 is driven to rotate in the direction indicated by the arrow at constant speed, the magnetic toner 1 is supplied to its peripheral surface from the hopper 4 as magnetically attracted by the magnet 3 disposed inside of the sleeve 2. The toner thus attracted is then transported to the contact line P where the toner becomes pressed between the pressure plate 5 and the sleeve 2 so that the toner becomes triboelectrically charged to a predetermined polarity and at the same time formed into a thin film 1*a* of predetermined thickness. At this time, however, since the bottom end portion of the pressure blade 5 is specifically shaped as described before, such a thin film 1*a* of toner is formed on the sleeve 2 only in the central region corresponding to the image forming region of the photosensitive belt 6. Thus, the thin film 1*a* of toner is virtually not formed in the side regions on both sides of the image forming region.

The thin film 1*a* of uniformly charged toner thus formed on the sleeve 2 only in the central region across the width $W_2$ is then transported to the developing region as the further rotation of the sleeve 2. On the other hand, an electrostatic latent image is formed on the photosensitive belt 6 as described before, so that the toner is selectively transferred to the latent image electrostatically from the sleeve 2 to have the latent image developed thereby converting the latent image into a visible toner image. Thereafter, the peripheral surface of sleeve 2 comes to the position where the discharging brush 7 is disposed so that the unnecessary charge remaining on the sleeve is thereby removed. Then, the peripheral surface of sleeve 2 comes back to the toner supply location where the hopper 4 is provided to receive a supply of toner 1 from the hopper 4 to start the next cycle of operation.

As described in detail above, in accordance with the present invention, since use is made of a specifically shaped pressure blade, a thin film of charged toner may be formed only in a region of interest the developing sleeve. This allows to use toner in a produced and floating toner drifting in the air, which could cause contamination of machine interior, is prevented from occurring. In addition, the present invention also contributes to form a developed toner image of high quality.

While the above provides a full and complete disclosure of the preferred embodiments of the present invention, various modifications, alternate constructions and equivalents may be employed without departing from the true spirit and scope of the invention. For example, instead of the above-described composite sleeve having a plurality of floating electrodes, use may also be made of an ordinary mono-layer sleeve of metal and the like. Moreover, if the pressure blade 5 is so provided to be biased against the sleeve 2, for example, by means of a spring or the like, the blade 5 may be made of any material including non-magnetic materials. Therefore, the above description and illustration should not be construed as limiting the scope of the invention, which is defined by the appended claims.

What is claimed is:

1. A device for developing an electrostatic latent image formed on an imaging surface by applying a film of toner thereto, comprising:

means for transporting said film of toner along a predetermined path through a developing region where said latent image is developed;

means for supplying toner to said means for transporting; and means disposed downstream of said means for supplying with respect to the transporting direction of toner for forming said film of toner, said means for forming including a blade pressed against said means for transporting and having a forward end portion which partly projects in a direction opposite to the direction of movement of said means for transporting so as to establish a sliding contact under pressure therebetween to form said film of toner on said means for transporting in a predetermined region thereof where said forward end portion is substantially in sliding contact with said means for transporting.

2. A device of claim 1 wherein said predetermined region corresponds to an image forming region of said imaging surface, whereby said film of toner is prevented from being formed in the region outside of the image forming region thereby preventing to waste the toner.

3. A device of claim 2 wherein said means for transporting includes a sleeve which is driven to rotate in a predetermined direction at constant speed and said blade has a projection having the width substantially of the width of said predetermined region and extending beyond a predetermined length from an imaginary reference line, which defines a contact line between said sleeve and said blade when both are brought into pressure contact.

4. A device of claim 3 further comprising a magnet as disposed inside of said sleeve, and said blade comprises a magnetic material, whereby said blade is pressed against said sleeve due to magnetic attraction by said magnet.

5. A device of claim 3 wherein said sleeve is comprised of a cylindrical base, a dielectric layer formed on the outer peripheral surface of said base and a plurality of floating electrodes provided as separate from each other at the surface of said dielectric layer.

6. A device of claim 3 wherein said toner is magnetic toner.

7. A device of claim 3 further comprising means disposed downstream of said developing region for removing remaining charge from said sleeve.

* * * * *